US009541286B2

(12) United States Patent
Storbacka et al.

(10) Patent No.: US 9,541,286 B2
(45) Date of Patent: Jan. 10, 2017

(54) METHOD FOR EXPANDING A CHEMICAL RECOVERY BOILER

(75) Inventors: Jan Storbacka, Kotka (FI); Petri Tikka, Karhula (FI)

(73) Assignee: Andritz Oy, Helsinki (FI)

( * ) Notice: Subject to any disclaimer, the term of this patent is extended or adjusted under 35 U.S.C. 154(b) by 1671 days.

(21) Appl. No.: 11/577,442

(22) PCT Filed: Oct. 18, 2005

(86) PCT No.: PCT/FI2005/000451

§ 371 (c)(1),
(2), (4) Date: Apr. 18, 2007

(87) PCT Pub. No.: WO2006/042901

PCT Pub. Date: Apr. 27, 2006

(65) Prior Publication Data

US 2009/0044767 A1 Feb. 19, 2009

(30) Foreign Application Priority Data

Oct. 18, 2004 (FI) ..... 20041348

(51) Int. Cl.
*F23G 7/04* (2006.01)
*D21C 11/12* (2006.01)
*F23M 5/08* (2006.01)

(52) U.S. Cl.
CPC ..... *F23G 7/04* (2013.01); *D21C 11/12* (2013.01); *F23M 5/08* (2013.01); *F23G 2203/70* (2013.01)

(58) Field of Classification Search
USPC .... 29/890.03, 890.051, 401.1; 110/238, 297, 110/346–348; 122/7 R, 235.33; 165/137
See application file for complete search history.

(56) References Cited

U.S. PATENT DOCUMENTS

| | | | | |
|---|---|---|---|---|
| 1,912,169 | A * | 5/1933 | Armacost | 122/298 |
| 2,035,337 | A | 3/1936 | Ostergaard | |
| 3,338,219 | A | 8/1967 | Riehl | |
| 4,940,004 | A * | 7/1990 | Jansen | 110/182.5 |
| 5,353,749 | A * | 10/1994 | Seibel et al. | 122/240.1 |
| 5,683,550 | A * | 11/1997 | Ryham | 162/30.1 |
| 7,393,496 | B2 * | 7/2008 | Saarinen et al. | 266/155 |
| 2002/0162491 | A1 * | 11/2002 | Saviharju et al. | 110/238 |

FOREIGN PATENT DOCUMENTS

| | | | |
|---|---|---|---|
| WO | WO 9827384 A1 * | 6/1998 | F22G 5/10 |
| WO | WO 98/43017 | 10/1998 | |
| WO | WO 02/081971 | 10/2002 | |

OTHER PUBLICATIONS

International Search Report mailed Feb. 14, 2006.
Declaration As of Prior Use of Extended Recovery Boilers Submitted in opposition to FI 122627 (corresponding to FI 20041348).

* cited by examiner

*Primary Examiner* — David Bryant
(74) *Attorney, Agent, or Firm* — Nixon & Vanderhye P.C.

(57) ABSTRACT

In a boiler, a space is reserved to expand the boiler by increasing the front and rear walls. To expand the boiler, wall additions are added to increase the width of the front and rear walls. After the expansion, the distance between the front and rear walls is substantially the same distance between the front and rear walls before the expansion.

12 Claims, 1 Drawing Sheet

METHOD FOR EXPANDING A CHEMICAL RECOVERY BOILER

CROSS RELATED APPLICATION

Figure 1:
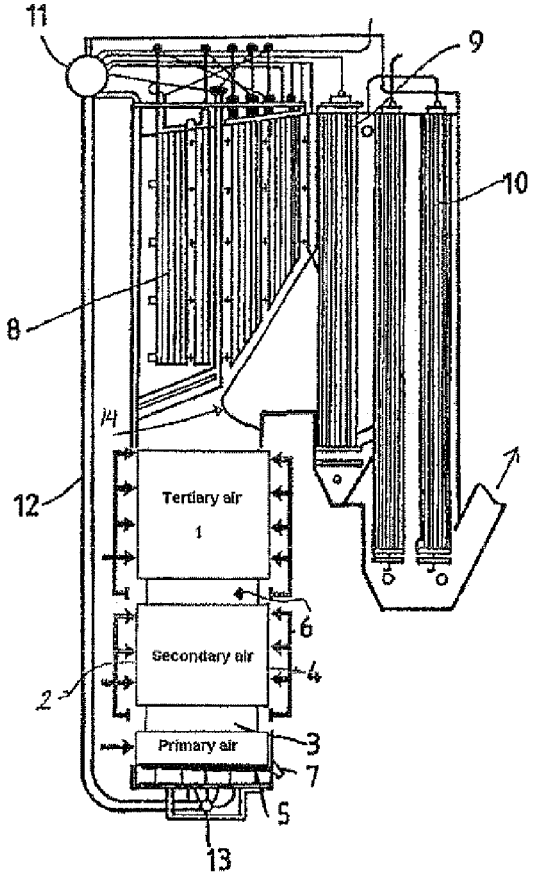

This application is the US national phase of international application PCT/FI2005/000451 filed 18 Oct. 2005 which designated the U.S. and claims benefit of Finnish patent application FI 20041348 filed 18 Oct. 2004, the entire contents of these applications are incorporated by reference.

The present invention relates to an arrangement and a method for enlarging a boiler, especially a chemical recovery boiler of a pulp mill, and specifically a furnace of the boiler, and thus for optimizing and simplifying the increase of the capacity thereof.

The furnace of a chemical recovery boiler for burning black liquor has a front wall, a rear wall and sidewalls. Black liquor spraying devices are disposed on said walls on one or several levels. A plurality of air ports are arranged on several horizontal levels on said walls for introducing air into the furnace from an air supply. Flue gas generated in black liquor combustion is led into contact with various heat transfer devices, superheaters, the boiler bank and water preheaters (economizers) of the boiler, whereby the heat present in the gas is recovered in water, steam or mixture thereof flowing in the heat transfer devices. A nose construction is disposed in the upper part of the furnace for directing the gas flow. Superheater elements suspended through the roof superheat the steam.

Air is introduced into the boiler usually at three different levels: primary air into the bottom part of the furnace, secondary air above the primary air level, but below the liquor nozzles, and tertiary air above the liquor nozzles for ensuring complete combustion. Air is usually fed in via several air ports either from all four walls of the boiler or from two opposites walls only. More than three air levels for introducing air into the furnace may be arranged in the boiler.

A feature common to new boiler plants delivered during the last years is that a new boiler with auxiliary equipment is predesigned in view of possible future capacity increase, if necessary. Typically this is accomplished by reserving space in the boiler building and structural steel constructions and oversizing the piping and auxiliary equipment with enough capacity for future loading of the boiler.

A wide capacity range creates problems in operation of the boiler. As to a chemical recovery boiler, too large a furnace complicates the maintaining of a high enough smelt bed temperature and appropriate superheating at low loads, whereas too small a furnace leads to plugging risks of the heat surfaces at high boiler loads. This could be avoided by enlarging the furnace when the loading of the boiler changes.

So far, the enlargement inside the chemical recovery boiler has been accomplished by reserving space for a relocation of the front (and rear) wall of the furnace, whereby the sidewalls are extended. This results in an increase in the distance between the front wall and the rear wall, which may cause problems in the combustion process itself. This involves problems especially when combustion air in the air arrangement is fed in mainly from the front and rear walls. Air penetration and air jet velocities on the secondary and tertiary air levels are key factors in the combustion process in the recovery boiler furnace. These parameters are optimized by selecting the right air port size. The right size depends on boiler loading in that an adequate amount of air must be fed via the air port to a proper penetration distance towards the opposite wall. If the number of the air ports is kept essentially unchanged when the distance to the opposite wall increases in the enlargement of the furnace, the size of the air port is bound to be a compromise for different boiler loads. In such a case, the best result in view of the combustion process in the boiler is not achieved. A typical air arrangement, wherein e.g. secondary air is fed in preferably from the front and rear walls only has been presented in WO-publication WO 02/081971.

An object of the present invention is to eliminate the above-mentioned disadvantages and provide for a boiler plant, which is easily adaptable for increasing the boiler load so that the efficiency of the combustion process does not suffer, and may still be controlled in an optimal way. An object of the invention is also a technically simpler and quicker way of accomplishing the enlargement compared to prior art. An object of the invention is an arrangement for optimizing certain air levels, especially the secondary and tertiary air flows of a chemical recovery boiler, before and after the enlargement of the furnace.

The present invention relates to a boiler, especially a chemical recovery boiler defined by a front wall, a rear wall and sidewalls. The invention is characterized in that space has been reserved in connection with the boiler for enlarging the boiler in such a way that a sidewall is moved, whereby the length of the front and rear wall extends.

Thus, a vital idea of the invention is to prepare for relocating one sidewall by extending the front and rear walls when modifying or building a boiler plant.

Also, the invention relates to a method in a boiler, especially in a chemical recovery boiler defined by a front wall, a rear wall and side walls, an essential characteristic being that the boiler is first operated in a first capacity range, whereafter the boiler is modified for operation in a second capacity range higher than the first range, by enlarging the boiler moving one side wall and providing the boiler accordingly with other devices/equipment and modifications required by the capacity increase.

The present invention provides an improved way of preparing for capacity increase of new boilers. Especially the method according to the invention allows for maintaining an optimized air feed and a constant penetration into the furnace with widely changing load levels, when a remarkable portion of or essentially all air at certain levels, specifically at secondary and tertiary levels, is introduced via the front and rear wall.

The distance between the front and rear wall does not change in the enlargement. Additional air required with the enlargement is introduced via additional air ports arranged in elongations of the front and rear wall. This means that the size of the air ports may be optimized for a boiler loading before the enlargement as well as a loading after that. In the WO-publication mentioned above, the air jets of a certain air level or certain air levels form vertical rows. The increase in the amount of combustion air required by the enlargement may be obtained by increasing the number of vertical air port rows in the elongations of the front and rear wall in a way required by the air feed system in question.

In accordance with the invention, during the layout design stage for the boiler plant, provisions are made for enabling the relocation of one sidewall of the boiler. Easily removable maintenance platforms are first installed along this removable sidewall. Other equipment is preferably located elsewhere inside the building. A steam drum is elongated and equipped with the necessary nozzles during the enlargement. A dissolving tank is built big enough in the first place for the enlargement, or space is reserved for future enlargement of the dissolving tank. Main headers are equipped with the necessary nozzles for the enlargement.

The furnace of the boiler has a width and a depth. The width of the furnace refers to the horizontal length of the furnace front wall and the depth refers to the horizontal length of the furnace sidewall. The so-called nose depth, which plays an important part in directing the flue gas streams into the upper part of the furnace and which typically comprises 40-45% of the total depth of the furnace, may be kept unchanged, because the length of the furnace sidewalls, and thus the total depth of the furnace do not change. The nose/sidewall proportion is desired to be the same before and after the enlargement.

Optimal steam velocity in the superheating elements suspended through the roof is important for ensuring adequate cooling of the superheater tubes, and on the other hand for avoiding an excessive pressure decrease. This is achieved in the present invention by increasing the number of superheating elements while maintaining an adequate transversal distance between the elements.

For minor loading, the use of excessively large and thus ineffective heat surfaces on the boiler bank and in the economizer part is avoided, as according to the invention additional tube panels are installed only in connection with the enlargement. The same applies to the superheater as well.

A further advantage of the invention is that before the enlargement soot blowers are used on one wall only with a smaller boiler capacity, because his solution does not affect the size of the boiler plant. Thus, initial investments and maintenance work are significantly reduced.

In a prior art enlargement method (transfer of a front/rear wall), at least four complete transversal tube weld lines are required on the front (rear) wall, which results in hundreds of tube/tube field welds forming potential leak risks in the most hazardous zones. The arrangement according to the invention reduces these critical welds to only two in the upper furnace headers.

In the arrangement according to the invention, the shutdown time for the boiler during the enlargement may be shortened compared to prior art methods, because the superheater, boiler bank and economizer elements can be preassembled in a dedicated space before effecting the enlargement. The furnace enlargement according to the invention is faster also due to easier site welding.

Figure 2:
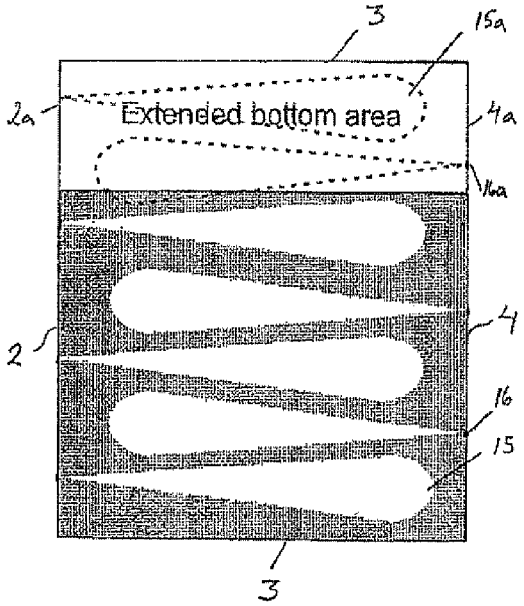

The present invention is described in more detail with reference to the appended figures, of which FIG. 1 illustrates schematically a typical chemical recovery boiler in side view, in connection with which boiler the present invention may be applied, and FIG. 2 illustrates a schematical cross-section of the bottom of the furnace according to the invention from an air level.

FIG. 1 illustrates a chemical recovery boiler construction with a furnace 1 defined by water tube walls: front wall 2, sidewalls 3 and rear wall 4, and a bottom 5 also formed of water tubes. Combustion air is fed into the furnace from several different levels as primary, secondary and tertiary airs. There may be other air levels as well. Spent liquor, such as black liquor, is introduced via nozzles 6 between the secondary and tertiary air zones. In the combustion process, a melt bed from the effluent is formed on the bottom 5 of the furnace, wherefrom the melt is discharged via a melt spout 7 fitted in the bottom of the furnace.

Heat recovery surfaces of the boiler, i.e. superheaters 8, are located above the furnace, and the rear wall 4 side of the furnace accommodates the heat surfaces following the superheaters above the furnace, the boiler bank 9 and the economizers 10, wherein the heat of the flue gas generated in the furnace is recovered in form of steam. In the superheaters the saturated steam is converted to a higher-temperature steam. On the boiler banks 9 of the boiler the water in a saturated temperature is boiled partly into steam and in the feed water preheaters 10 the water is heated by means of flue gas prior to leading the water into the vaporizing part 9 of the boiler and into the superheating parts 8. The so-called nose is shown with reference numeral 14.

The water/steam circulation of the boiler is effected by means of natural circulation, whereby the water/steam mixture generated in the water tubes of the boiler walls and bottom flows upwards via collection tubes into a steam drum 11 arranged crosswise in relation to the boiler, i.e. in the direction of the front wall 2. Hot water flows from the steam drum via drain tubes 12 into the bottom manifold 13, wherefrom the water is distributed into the bottom water tubes and further into the water tube walls.

FIG. 2 illustrates the enlargement zone reserved in the boiler for the relocation of one sidewall 3 when an enlargement to the boiler is desired. The sidewall is moved to the extent of the length of the elongation 2*a*, 4*a* of the front/rear wall. FIG. 2 further shows schematically air jets 15 via air ports 16, the number of air jets in this arrangement comprising with a lower boiler capacity two jets on the rear wall 4 and three jets on the front wall 2. The required additional air is received into the enlargement by arranging more air ports 16*a* and via them air jets 15*a* in the elongation 2*a*, 4*a* of the front and rear wall. During the enlargement, there is no need to change the operation of the existing air ports and the air jets flowing therethrough.

The measures connected to the boiler enlargement are as such known to a person skilled in the art, and thus have not been more widely described in this connection.

Though the present invention has been described in the connection, which at present is considered the most practical and preferred embodiment, it is to be understood that the invention is not to be limited to the presented embodiment, but in the opposite it is intended to cover various modifications and corresponding arrangements in the spirit and scope of the appended claims. For example, the application of the invention is not limited to a certain air arrangement, although the advantages of the invention become especially obvious when the main portion of the air on certain levels is fed in via the front and rear wall.

The invention claimed is:

1. A method for expanding a chemical recovery boiler having a front wall, a rear wall and a pair of side walls between the front and rear walls, the method comprises:

operating the chemical recovery boiler in a first capacity range wherein the front wall, the rear wall and the pair of sidewalls define a combustion zone and the pair of sidewalls is separated by a first distance and the front wall and the rear wall are separated by a third distance, wherein at least one of the front wall and rear wall includes a secondary air nozzle;

positioning at least one sidewall such that the pair of sidewalls is separated by a second distance greater than the first distance;

attaching the at least one sidewall to the front wall and the rear wall, wherein the pair of sidewalls is separated by a second distance greater than the first distance and the combustion zone has an increased volume due to the greater distance between the pair of sidewalls and wherein the front wall and the rear wall remains separated by the third distance after attaching the at least one sidewall;

in cooperation with attaching the at least one sidewall to the front wall and the rear wall, increasing a width of the front wall and the rear wall such that the third distance between the front wall and the rear wall when the boiler operates in the first capacity range is substantially equal to the third distance between the front wall and the rear wall when the boiler operates at a capacity greater the first capacity range;

adding at least one secondary air nozzle to at least one of the front wall and the rear wall, wherein the added secondary air nozzle is on a section of the front wall or rear wall added in conjunction with the increase of the width of the front wall and the rear wall, and after attaching the at least one sidewall, increasing the width of the front wall and the rear wall and adding the at least one secondary air nozzle, operating the chemical recovery boiler at the capacity greater than the first capacity range.

2. A method as in claim 1 wherein positioning the at least one sidewall includes moving the sidewall from a first position to a second position.

3. A method as in claim 1 wherein modifying the boiler includes providing additional air capacity by adding the secondary air nozzle and a tertiary air nozzle arranged on the added section of the front wall.

4. A method as in claim 1 wherein adding at least one air nozzle includes adding at least one tertiary air nozzle and at least one secondary air nozzle.

5. The method of claim 1 wherein the pair of sidewalls lack a secondary air nozzle before and after the extension of the front wall and the rear wall.

6. A method as in claim 1 further comprising adding at least one tertiary air nozzle to at least one of the front wall and the rear wall.

7. A method as in claim 6 wherein the added tertiary air nozzle is on a section of the front wall or rear wall added in modifying the boiler.

8. A method to expand a chemical recovery boiler having a front wall, a rear wall and a pair of side walls defining a combustion zone, the method comprises:

operating the chemical recovery boiler in a first capacity range wherein the front wall, the rear wall and the pair of sidewalls define a combustion zone and the pair of sidewalls is separated by a first distance and the front wall and the rear wall are separated by a third distance, wherein at least one of the front wall and rear wall includes a secondary air nozzle;

removing a sidewall of the pair of sidewalls from between the front wall and rear wall;

positioning the removed sidewall a distance from the opposite sidewall greater than the first distance;

extending the front wall and the rear wall;

connecting the extended front wall and extended rear wall to the pair of the side walls after the positioning of the removed sidewall , wherein the extended front wall and the extended rear wall remain separated by the third distance after being connected to the pair of the side walls;

adding at least one air nozzle to an extended portion of the front wall or the rear wall, and after the connection of the extended front wall and the extended rear wall to the pair of the side walls and after the addition of the at least one air nozzle, operating the chemical recovery boiler at a capacity greater than the first capacity range.

9. A method as in claim 8 wherein positioning the sidewall includes moving the sidewall from a first position to a second position.

10. A method as in claim 8 wherein extending the front wall and rear wall includes extending by substantially equal distances the front wall and the rear wall.

11. A method as in claim 8 wherein adding at least one air nozzle includes adding at least one tertiary air nozzle.

12. The method of claim 8 wherein the pair of sidewalls lack a secondary air nozzle before and after the extension of the front wall and the rear wall.

* * * * *